US006081926A

United States Patent [19]

Krause et al.

[11] Patent Number: 6,081,926

[45] Date of Patent: Jul. 4, 2000

[54] EXPANDABLE SHIRT COLLAR

[76] Inventors: Arthur A. Krause, 20539 Archwood St., Ninnetka, Calif. 91306; Walter K. Lim, 14720 Horticultural Dr., Hacienda Heights, Calif. 91745

[21] Appl. No.: 09/172,358

[22] Filed: Oct. 14, 1998

[51] Int. Cl.[7] ..... A41B 3/00

[52] U.S. Cl. ..... 2/129

[58] Field of Search ..... 2/129, 130, 133, 2/98, DIG. 4, 113–115, 105, 106, 69

[56] References Cited

U.S. PATENT DOCUMENTS

| | | | |
|---|---|---|---|
| 1,110,187 | 9/1914 | Cooper | 2/129 |
| 1,116,488 | 11/1914 | Rodden | 2/129 |
| 1,963,004 | 6/1934 | Tucker . | |
| 2,025,485 | 12/1935 | Tucker . | |
| 2,087,532 | 7/1937 | Shepherd . | |
| 2,099,520 | 11/1937 | Hendrycy | 2/129 |
| 2,101,380 | 12/1937 | Alston . | |
| 2,396,842 | 3/1946 | Franklin . | |
| 2,996,723 | 8/1961 | Ainslie . | |
| 3,148,377 | 9/1964 | Andersen . | |
| 3,328,808 | 7/1967 | Ambrose . | |
| 3,393,406 | 7/1968 | Hollinger et al. . | |
| 4,937,884 | 7/1990 | Sherman . | |
| 5,274,853 | 1/1994 | Millican . | |

*Primary Examiner*—Gloria Hale
*Attorney, Agent, or Firm*—Dennis H. Lambert

[57] ABSTRACT

An expandable shirt collar has one or more transverse reinforced cuts or openings in the neckband which spread apart or open when a longitudinal force is applied to the neckband to effectively elongate the neckband to compensate for shrinkage of the shirt collar or an increase in neck size of the wearer. In one form of the invention, a vertically oriented button hole at one end of the band may serve as the cut or opening, either alone or in combination with additional cuts or openings spaced from the ends of the band. In another form of the invention, a piece of expandable pleated material may be sewn into the cut or opening. Also disclosed are a button having an elongate oval shape, and/or a notched periphery, to facilitate placement of the button through a button hole.

17 Claims, 5 Drawing Sheets

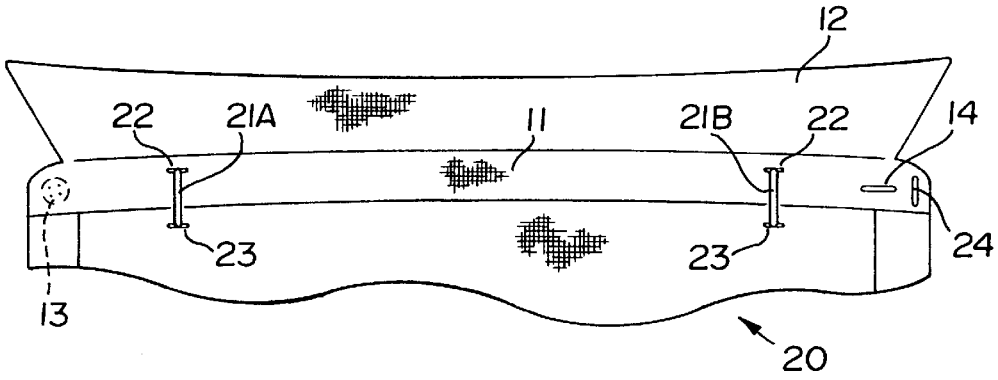
FIG. 3
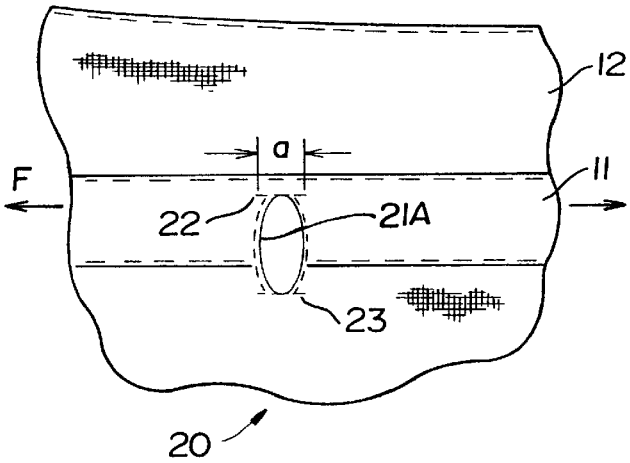
FIG. 4
FIG. 5
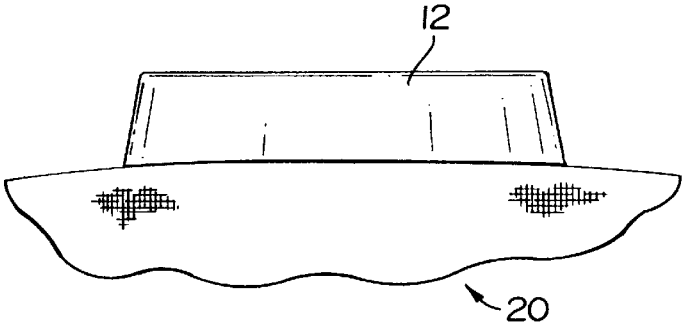
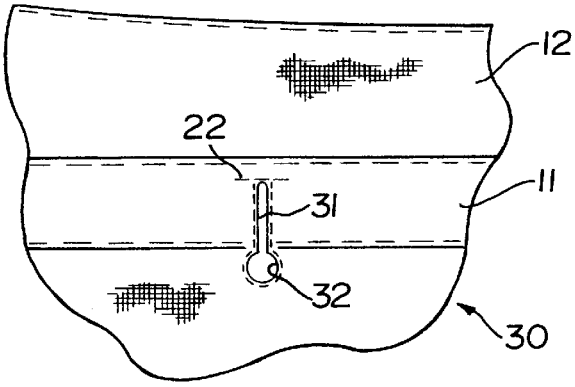
FIG. 6

EXPANDABLE SHIRT COLLAR

BACKGROUND OF THE INVENTION

1. Field of the Invention

This invention relates generally to garments. More particularly, the invention relates to a shirt having an expandable collar to enable the collar to adjust to different neck sizes and to compensate for shrinkage of the shirt.

2. Description of the Prior Art

Shirts having collars, e.g., dress shirts, are normally sold in sizes based upon the circumference of the collar and the length of the sleeves. Collar sizes typically vary in half inch increments, i.e., 15, 15½, 16, 16½ etc. A purchaser selects a shirt having a neck size nearest to the circumference of his neck, and when new the shirt generally fits comfortably. However, the shirt may shrink when it is laundered, resulting in the neck size not being as large as that originally selected. Additionally, the neck size of the person wearing the shirt may vary over a short period of time. Either or both of these circumstances can result in the collar being too tight about the person's neck, making it uncomfortable or even impossible to wear.

Various solutions to the problem have been offered in the prior art. For instance, in U.S. Pat. No. 2,396,842 to Franklin, reinforced stitching is placed in the neckband during manufacture of the shirt, with the stitching extending generally transversely of the length of the neckband, and resembling the stitching around a button hole. If the collar becomes too tight for some reason, the fabric in the area bordered by the stitching can be cut, thereby enabling the neckband to expand slightly, effectively increasing the length of the neckband. The opening formed by cutting the material bordered by the reinforced stitching is disposed wholly within the neckband, and the top and bottom edges of the neckband remain unaffected. Thus, elongation of the neckband is limited due to the restraining effect of the stitching at the top and bottom edges of the neckband. Moreover, in order for the invention shown in this patent to be operative, it is necessary for the user to cut the fabric bordered by the reinforced stitching.

Other solutions to this problem have been offered by U.S. Pat. No. 2,025,485 to Tucker, U.S. Pat. No. 2,087,532 to Shepherd, U.S. Pat. No. 2,996,723 to Ainslie, U.S. Pat. No. 3,148,377 to Anderson, U.S. Pat. No. 3,328,808 to Ambrose and U.S. Pat. No. 4,937,884 to Sherman. All of these patents rely upon some form of elastic material to permit the circumference of the collar to expand to accommodate to different neck sizes.

U.S. Pat. No. 2,101,380 to Alston discloses a different arrangement, wherein a box pleat is formed completely along the back of the shirt and through the neckband, with an adjustable strap and buckle to enable the pleat to be closed or opened.

U.S. Pat. No. 5,274,853 to Millican discloses another arrangement, wherein multiple fasteners are provided in order to adjust the circumference of the shirt collar, depending upon which fastener is selected.

Many of these prior art arrangements are relatively complicated and expensive to manufacture, and/or require specific action or manipulation by the user, and/or apply a constant compressive force to the neck.

Accordingly, there is need for a simple and economical means associated with the collar of a shirt to enable the size of the collar to automatically expand to compensate for shrinkage of the shirt and/or an increase in the neck size of the user.

SUMMARY OF THE INVENTION

Simple and economical means is associated with the neckband in the collar of the present invention, operative to automatically effectively increase the length of the neckband to compensate for shrinkage of the shirt and/or an increase in the neck size of the user.

The foregoing is achieved by providing one or more transverse cuts or openings extending at least partially across the width of the neckband, whereby when tension or force is applied along the length of the neckband, the cuts or openings expand or spread apart, effectively lengthening the neckband. In one form of the invention, the cuts or openings are preferably placed near but spaced from the opposite ends of the neckband, where they will have greater effect on the length of the neckband. Additionally, the cuts or openings extend through the bottom edge of the neckband, whereby elongation of the neckband can occur to a greater extent than if the cut is limited to the area of the neckband between the top and bottom edges.

In lieu of the transverse cut or cuts between the ends of the neckband, a generally vertically or transversely oriented button hole may be provided in the end of the neckband for cooperation with the collar button on the other end thereof. The vertical orientation of the button hole enables the button hole to spread when a longitudinal force is applied to the neckband, effectively increasing the circumference of the collar by a slight amount.

A variety of different configurations of transverse cuts or openings are provided in the invention, and in one form a relatively large transverse cut-out is made in at least one location in the neckband, and a piece of pleated fabric is sewn therein.

In accordance with another aspect of the invention, the collar button may be made in the shape of an elongate oval to facilitate insertion of the button through the button hole.

In a further variation, the collar button may have a notched outer circumference to facilitate gripping of the button during efforts to insert it through the button hole.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 3 is a fragmentary view similar to FIG. 2, showing a second embodiment of the invention, and wherein a vertically oriented button hole is provided at one end of the neckband;

FIG. 4 is an enlarged fragmentary view of a portion of the collar of FIG. 3, showing how the cut expands or spreads apart upon application of a longitudinal force to the neckband, effectively increasing the length of the neckband;

FIG. 5 is a fragmentary rear view in elevation of a collar in accordance with the invention, illustrating how the expandable transverse cuts or openings in the neckband are hidden from view when the shirt is in use;

FIG. 6 is an enlarged fragmentary view similar to FIG. 4 of a third embodiment of the invention, wherein an enlarged rounded opening is provided at the bottom end of the transverse cut, just below the neckband;

DETAILED DESCRIPTION OF THE PREFERRED EMBODIMENTS

Figure 1:
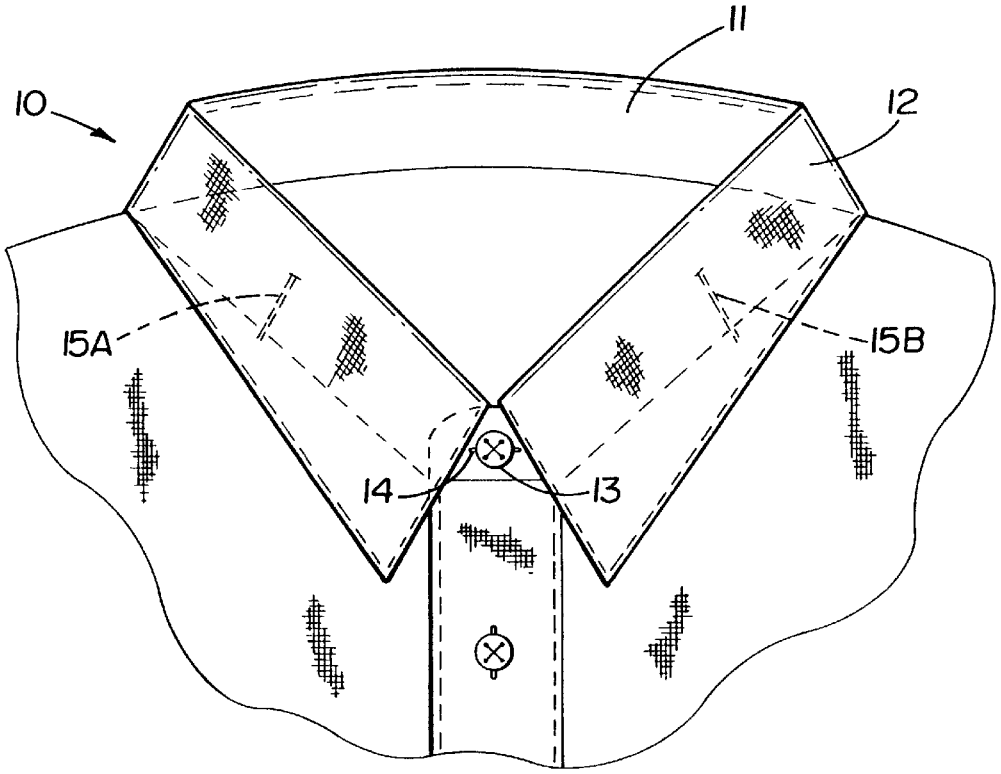
FIG. 1 is a fragmentary front view in elevation of a shirt collar utilizing the invention.
Figure 2:
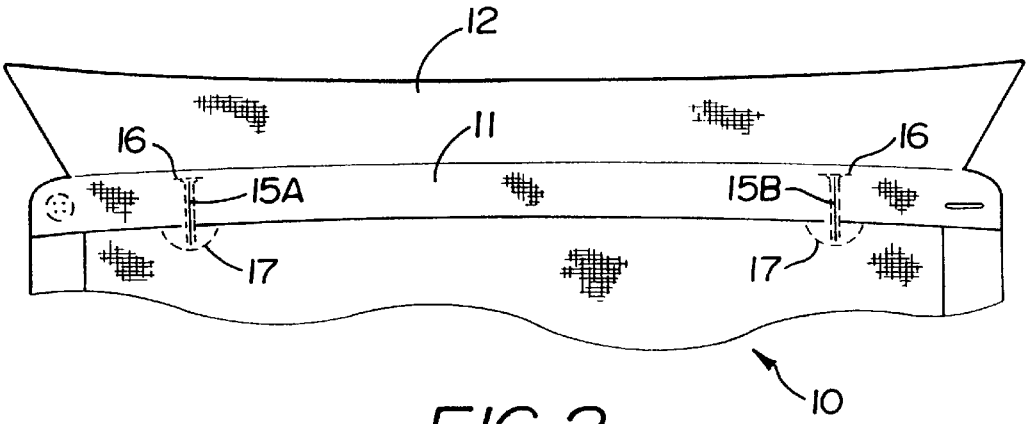
FIG. 2 is a front view of the collar of FIG. 1, with the shirt opened up and the collar in an upwardly extended position, showing a first embodiment of the invention wherein the reinforcing stitching at the bottom end of the transverse cuts has an upwardly curved configuration.

Referring more specifically to the drawings, a shirt incorporating a first embodiment of the invention is indicated generally at 10 in FIGS. 1 and 2. In this type of shirt, a neckband 11 is sewn to the body of the shirt, and a collar 12 is sewn to the neckband. A collar button 13 and button hole 14 in opposite ends of the neckband are utilized to hold the collar in closed position about the neck of the wearer.

A pair of vertical cuts 15A and 15B are made across substantially the entire width of the neckband 11, terminating slightly spaced from the upper edge thereof, but extending up to one half inch below the bottom edge thereof. A short line of stitching 16 reinforces the upper ends of the cuts 15A and 15B, and an arcuate upwardly curved line of stitching 17 extends across and reinforces the lower ends thereof.

A second embodiment of the invention is indicated generally at 20 in FIGS. 3, 4 and 5. In this form of the invention, elongate cuts 21 and 22 are made transversely in the neckband 11, extending across the bottom edge of the neckband into the body of the shirt, but terminating at their upper ends spaced from the top edge of the neckband. The cuts are reinforced with stitching, such as used in reinforcing button holes, and preferably include short lines of reinforcing stitching 22 and 23 applied across the upper and lower ends, respectively, of the cuts 21A and 21B.

In addition, a generally vertically oriented second button hole 24 may be provided in the end of the neckband adjacent the conventional button hole 14. Either button hole may be used, depending upon the extent of elongation or lengthening of the neckband that is desired.

As depicted in FIG. 4, when a longitudinal force F is applied to the collar, the cut 21A (and 21B) expands or spreads apart a distance "a", effectively lengthening the neckband 11 an amount equal to two times "a".

A third embodiment of the invention is indicated generally at 30 in FIG. 6. In this form of the invention, a transverse cut 31 extends upwardly through the bottom edge of the band 11 and terminates spaced from the upper edge thereof. A short section of reinforcing stitching 22 is extended across the upper end of the cut 31, and an enlarged rounded opening or cut-out 32 is formed at the lower edge thereof, just below the bottom edge of neckband 11. The opening 32 facilitates spreading or opening of the cut 31 when a longitudinal force is applied to the neckband.

Figure 7:
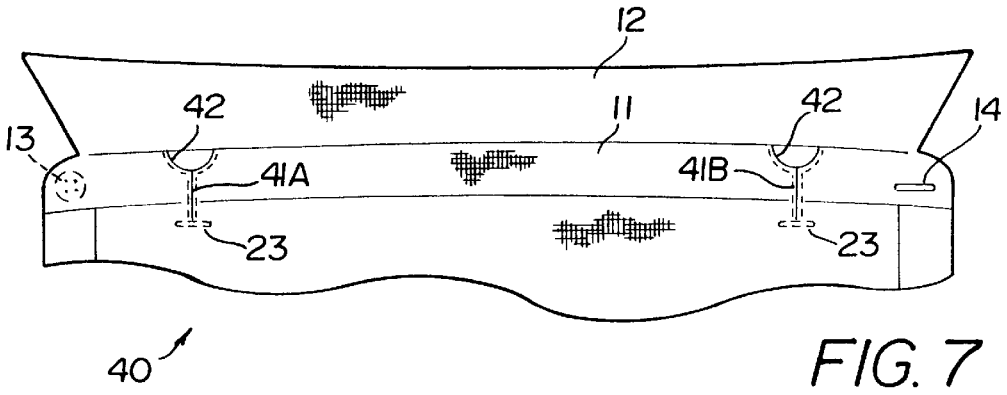
FIG. 7 is a fragmentary view similar to FIG. 3 of a fourth form of the invention, wherein a half-moon shaped cut-out is formed at the top of the transverse cut, at the top edge of the neckband.

A fourth embodiment of the invention is indicated generally at 40 in FIG. 7. In this form of the invention, transverse cuts 41A and 41B are made in the neckband 11, extending through the bottom edge thereof, and reinforced at their bottom ends by short lines of stitching 23. Generally half-moon shaped cut-outs 42 are made at the upper edge of the band and extend from the upper ends of the cuts 41A and 41B to the upper edge of the neckband. These cut-outs facilitate expansion or spreading of the cuts 41A and 41B, and elongation of the neckband, to a greater extent than that form of the invention shown in FIGS. 2 and 3, for example.

Figure 8:
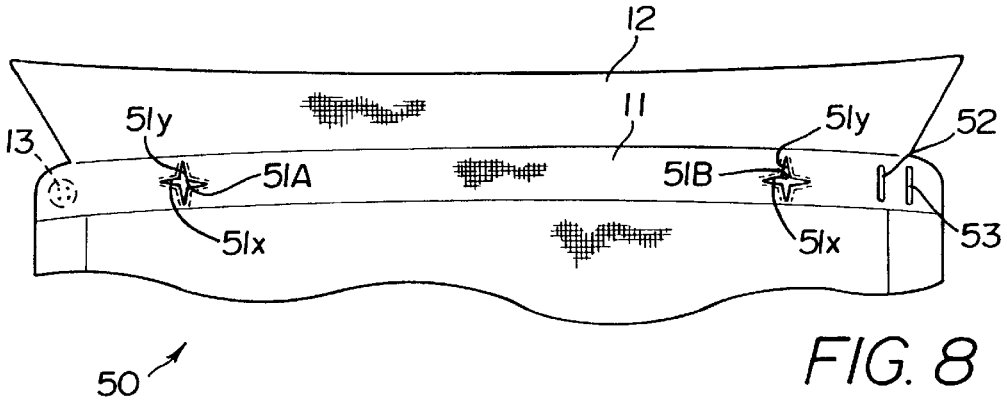
FIG. 8 is a fragmentary view similar to FIG. 7 showing a fifth form of the invention, wherein the transverse cut is generally star-shaped in configuration, including intersecting transverse and longitudinal cuts or openings.

A fifth embodiment of the invention is indicated generally at 50 in FIG. 8. In this form of the invention, generally star-shaped cut-outs 51A and 51B are made in the neckband 11, comprised of intersecting horizontal and vertical cutouts 51*x* and 51*y*, respectively. Additionally, in this form of the invention, a pair of generally vertically oriented button holes 52 and 53 are provided in lieu of the conventional horizontal button hole 14. It should be understood, however, that the button holes 52 and 53 need not be provided, and the star-shaped openings 51A and 51B could be used in combination with a conventional button hole, if desired.

Figure 9:
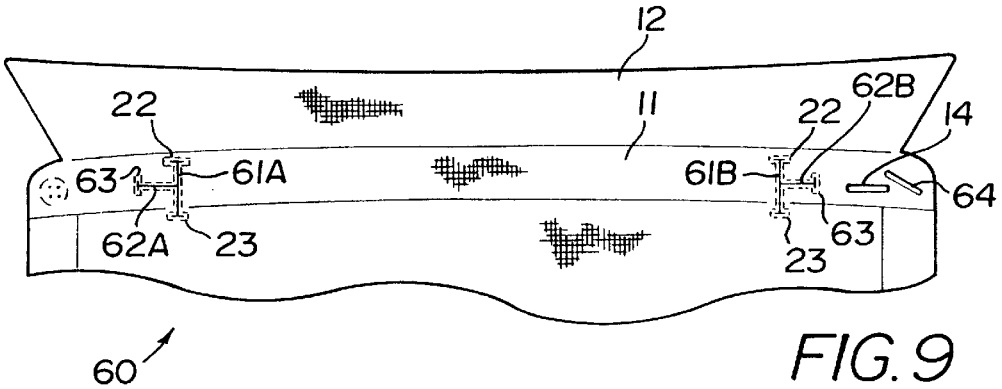
FIG. 9 is a view similar to FIG. 8 of a sixth form of the invention, wherein the transverse cut is intersected intermediate its ends by a longitudinal cut.

A sixth embodiment of the invention is indicated generally at 60 in FIG. 9. In this form of the invention, transverse cuts 61A and 61B extend upwardly through the bottom edge of the neckband 11 and substantially across its width. The top and bottom ends of the transverse cuts 61A and 61B are reinforced by short horizontal lines of stitching 22 and 23. The transverse cuts 61A and 61B are intersected intermediate their upper and lower ends by horizontal cuts 62A and 62B, respectively, reinforced at their outer edges or ends with a vertical line of stitching 63. The horizontal cuts 62 and 62B promote curling or release of the material of the neckband when a longitudinal force is applied thereto, to facilitate spreading or opening of the transverse cuts 61A and 61B. Additionally, an angled button hole 64 is provided between the conventional button hole 14 and the terminal end of the neckband 11. As before, it is to be understood that this button hole 64 may be omitted if desired, or used in lieu of the conventional button hole 14.

Figure 10:
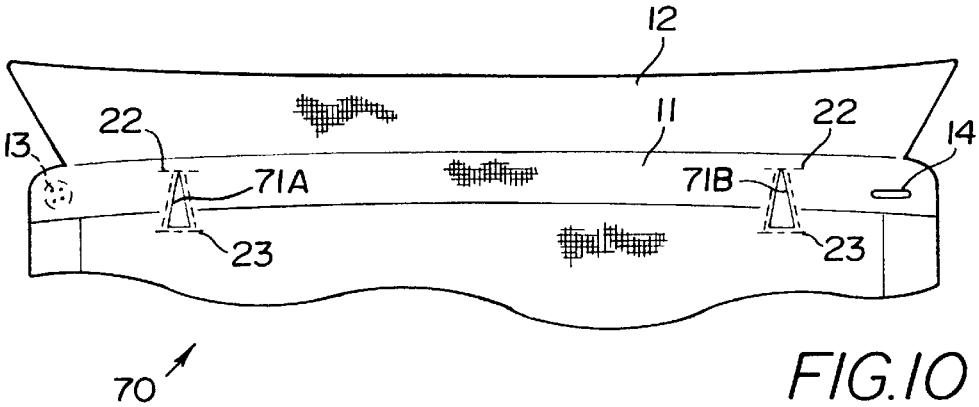
FIG. 10 is a view similar to FIG. 9 of a seventh form of the invention, wherein the transverse cuts comprise inverted V-shaped openings extending upwardly into the neckband through its bottom edge.

A seventh embodiment of the invention is indicated generally at 70 in FIG. 10. In this form of the invention, a pair of inverted V-shaped cut-outs or openings 71A and 71B are formed upwardly through the bottom edge of the neckband 11. These openings are reinforced with stitching as in the previous forms of the invention, and include lines of stitching 22 and 23 across the upper and lower ends thereof.

Figure 11:
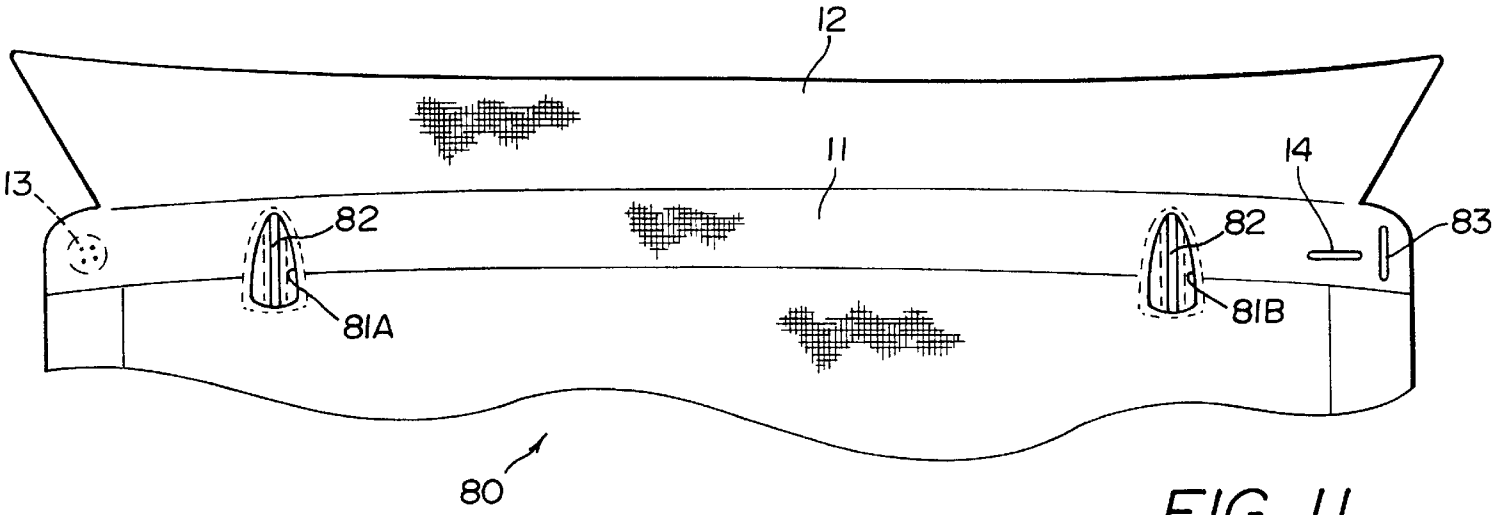
FIG. 11 is view similar to FIG. 10 of an eighth form of the invention, wherein a piece of pleated fabric is sewn into the transverse opening cut into the neckband.

An eighth embodiment of the invention is indicated generally at 80 in FIG. 11. In this form of the invention, a pair of enlarged shaped openings or cut-outs 81A and 81B are formed in the neckband 11, spaced from the upper edge thereof but extending through the lower edge. A piece of pleated fabric 82 is sewn in the openings 81A and 81B, with the pleats extending vertically or transversely to the longitudinal dimension of the neckband 11. Accordingly, when a longitudinal force is applied to the neckband, the pleats expand, effectively lengthening the neckband. Moreover, a generally vertically oriented button hole 83 may be provided between the conventional button hole 14 and the terminal end of the neckband 11, if desired. Of course, it should be understood that either or both of the button holes 14 and 83 could be used with the pleated panels 82, as desired.

Figure 14:
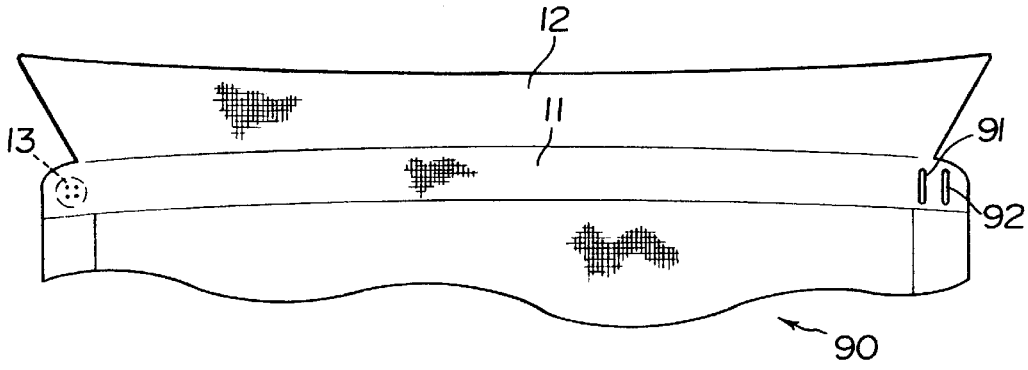
FIG. 14 is a view similar to FIG. 11, wherein the transverse cuts or openings in the neckband comprise a pair of vertically oriented button holes at one end of the neckband.

A ninth embodiment of the invention is indicated generally at 90 in FIG. 14. In this form of the invention, the transverse cuts in the neckband 11 comprise a pair of generally vertically oriented button holes 91 and 92 in the end of the neckband opposite the end to which the collar button 13 is attached. By selection of one or the other of the button holes 91 and 92, the effective circumference of the collar can be altered. Moreover, the vertical orientation of the button holes enables them to expand or spread slightly when a longitudinal force is applied to the neckband 11, permitting the effective length of the neckband to increase to compensate for shrinkage of the shirt or an increase in the neck size of the person wearing the shirt.

Although the various forms of the invention described above have utilized a pair of transverse cuts or openings formed in the neckband of the shirt, it is to be understood that one or more cuts or openings could be provided at different locations along the length of the neckband, depending upon the desired result. For instance, multiple cuts or openings will enable greater elongation of the neckband, and placement of the cuts or openings closer to the ends of the neckband also results in greater elongation than if the cut or opening is placed intermediate the ends of the neckband.

Further, the cuts or openings can extend completely across the width of the neckband, or they can extend half way or less, across the width. It is preferred that the upper ends of the cuts be spaced from the upper edge of the neckband to insure against deformation of the collar, or risk of exposing the cut.

The provision of the cuts or openings in accordance with the invention is a simple and economical way to enable the collar of a shirt to adjust to different sizes to compensate for shrinkage of the shirt or an increase in the neck size of the wearer.

Figure 12:
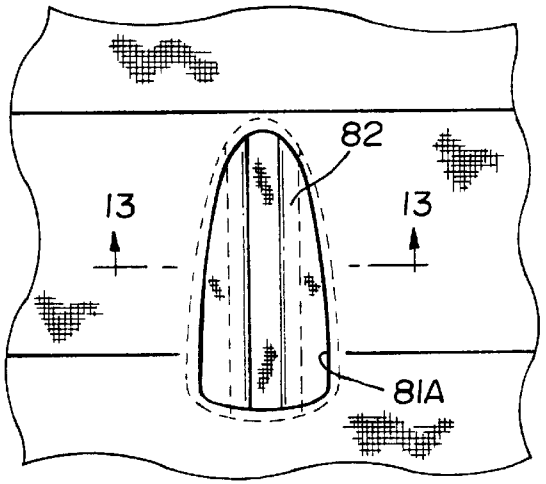
FIG. 12 is a greatly enlarged fragmentary view of a portion of the neckband and collar of FIG. 11, showing greater details of the opening and piece of pleated fabric.
Figure 13:
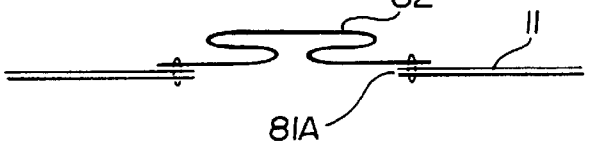
FIG. 13 is a sectional view taken along line 13—13 in FIG. 12.

Moreover, if is desired to avoid the formation of an opening that exposes the skin when the cuts are opened due to the application of a longitudinal force to the neckband, a piece of elastic material may be sewn across the cut or opening to perform essentially the same function as performed by the pleated material 82 in that embodiment of the invention shown in FIGS. 11–13. However, since the collar hides the neckband when the shirt is being worn, it is not necessary lo provide any material to close the openings formed by the cuts.

Incorporation of the invention into a shirt can enable the collar size to increase from about one quarter inch up to about five eighths of an inch. This increase in size will make the shirt more comfortable to wear, and will make it easier to button. Moreover, an increase in the effective length or circumference of the collar can insure that the appearance of the collar remains unaffected, because any distortion that might be caused by an ill-fitting tight collar is eliminated.

Manufacturers and/or retailers may find the invention to be desirable because it could enable them to stock fewer sizes, thereby making room for more styles. This would also reduce the number of shirts in odd sizes that are required to be stocked but that may not sell. Further, the invention may be a value-added feature, enabling the shirt to be priced higher than conventional shirts.

Figure 15:
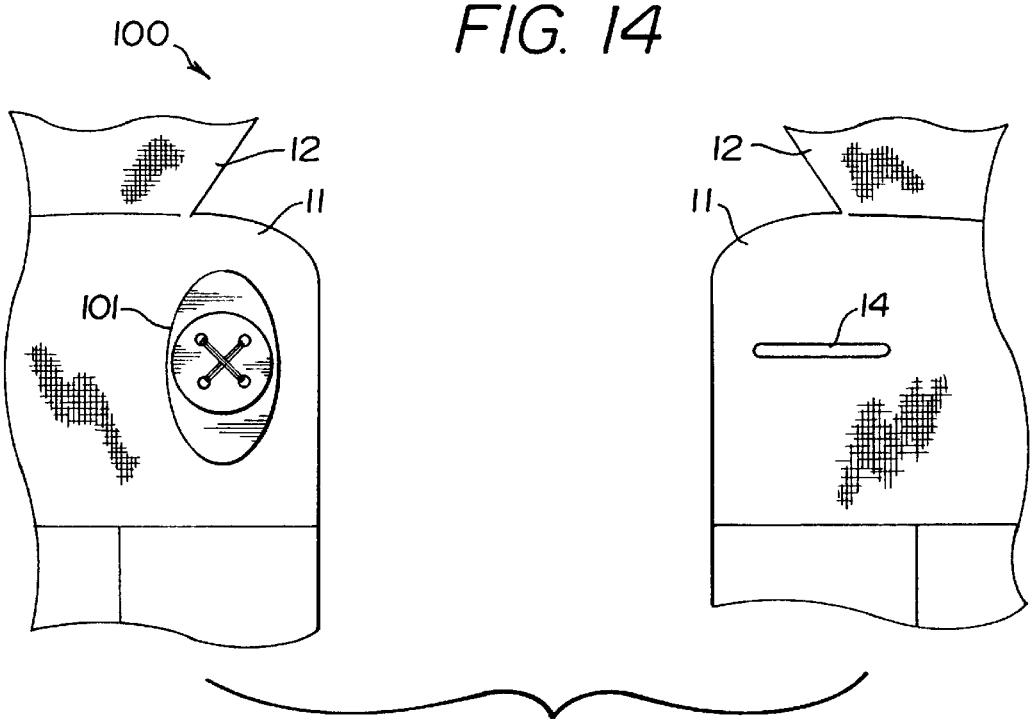
FIG. 15 is an enlarged, fragmentary, exploded view of another aspect of the invention, wherein the collar button has an elongate oval shape to facilitate insertion thereof through the button hole.

Another aspect of the invention is indicated generally at 100 in FIG. 15, wherein the collar button 101 has an elongate oval shape in a vertical direction. This facilitates insertion of the button through the button hole 14 because the button can have a narrower width than the length of the button hole 14, and yet the length of the button 101 is substantial, thereby avoiding inadvertent withdrawal of the button through the button hole.

Figure 16:
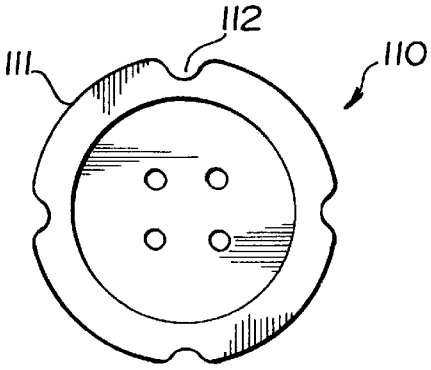
FIG. 16 is an enlarged view in front elevation of a collar button having a notched outer circumference.
Figure 17:
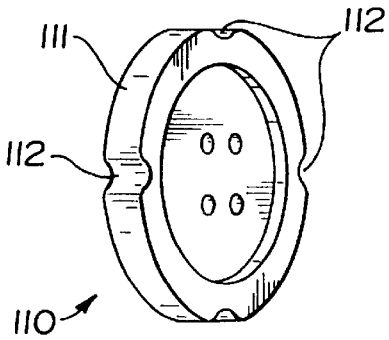
FIG. 17 is a front perspective view of the collar button of FIG. 16.

A further feature of the invention is indicated generally at 110 in FIGS. 16 and 17. In these figures, a collar button 111 has one or more notches or grooves 112 formed in its circumference to facilitate gripping of the button when it is being inserted through a button hole.

The features of FIGS. 15–17 can be utilized alone or in combination with the other features of the invention described and illustrated herein.

While particular embodiments of the invention have been illustrated and described in detail herein, it should be understood that various changes and modifications may be made to the invention without departing from the spirit and intent of the invention as defined by the scope of the appended claims.

What is claimed is:

1. In a shirt having a shirt body, an elongate neckband, and a collar, wherein the neckband is adapted to encircle the neck of a wearer and has upper and lower edges connected to the collar and to the shirt body, respectively, and opposite ends, and a fastening means is on the ends of the neckband for securing the neckband and thus the collar about the neck of a wearer, the improvement comprising:

at least one cut formed transversely in the neckband, but not the collar, extending through the lower edge thereof, but not the upper edge, to enable the material of the neckband to spread apart at the cut when a longitudinal force is applied to the neckband, thereby increasing the effective length of the neckband to compensate for shrinkage of the shirt or an increase in neck size of the wearer.

2. A shirt collar as claimed in claim 1, wherein:

reinforcing stitching is placed around said at least one cut.

3. A shirt collar as claimed in claim 2, wherein:

said at least one cut is placed near but spaced from an end of the neckband.

4. A shirt collar as claimed in claim 3, wherein:

there are multiple cuts formed in the neckband.

5. A shirt collar as claimed in claim 4, wherein:

the cuts are positioned inwardly from the opposite ends of the neckband a distance approximately one fourth the length of the neckband.

6. A shirt collar as claimed in claim 1, wherein:

said at least one cut extends through the lower edge of the neckband and at least approximately one half the width of the neckband.

7. A shirt collar as claimed in claim 1, wherein:

said at least one cut extends through the lower edge of the neckband and across the width of the neckband, but terminates short of the upper edge thereof.

8. A shirt collar as claimed in claim 1, wherein:

said at least one cut is a slit made transversely in the neckband.

9. A shirt collar as claimed in claim 1, wherein:

said at least one cut has an upper end terminating in a semi-circular opening having a lower curved edge and an upper edge coterminous with the upper edge of the neckband.

10. A shirt collar as claimed in claim 1, wherein:

said at least one cut comprises an inverted V-shaped opening extending upwardly into the neckband through the lower edge thereof.

11. A shirt collar as claimed in claim 1, wherein:

said fastening means comprises at least one button hole at one end of the neckband, and a button at the other end.

12. A shirt collar as claimed in claim 11, wherein:

there are a pair of closely spaced button holes extending parallel to one another and transverse through the neckband.

13. A shirt collar as claimed in claim 11, wherein:

the button hole extends along an imaginary line angularly disposed between the upper and lower edges of the neckband.

14. In a shirt having a shirt body, an elongate neck band and a collar, wherein the neckband is adapted to encircle the neck of a wearer and has upper and lower edges connected to the collar and to the shirt body, respectively, and a fastening means is on the ends of the neckband for securing the neckband and opposite ends, and thus the collar about the neck of a wearer, the improvement comprising:

at least one cut formed transversely in the neckband to enable the material of the neckband to spread apart at the cut when a longitudinal force is applied to the neckband, thereby increasing the effective length of the neckband to compensate for shrinkage of the shirt or an increase in neck size of the wearer; and said at least one cut comprises a star-shaped opening defined by intersecting longitudinal and transverse openings each tapering to a point, said star-shaped opening being located between the upper and lower edges of the neckband.

15. In a shirt having a shirt body, an elongate neckband, and a collar, wherein the neckband is adapted to encircle the neck of a wearer and has upper and lower edges connected to the collar and to the shirt body, respectively, and opposite ends, and a fastening means is on the ends of the neckband for securing the neckband and thus the collar about the neck of a wearer, the improvement comprising:

at least one cut formed transversely in the neckband, extending through the lower edge thereof, to enable the material of the neckband to spread apart at the cut when a longitudinal force is applied to the neckband, thereby increasing the effective length of the neckband to compensate for shrinkage of the shirt or an increase in neck size of the wearer, said at least one cut comprising intersecting longitudinal and transverse slits made in the neckband, and said longitudinal slit being approximately intermediate the upper and lower edges of the neckband.

16. In a shirt having a shirt body, an elongate neckband, and a collar, wherein the neckband is adapted to encircle the neck of a wearer and has upper and lower edges connected to the collar and to the shirt body, respectively, and opposite ends, and a fastening means is on the ends of the neckband for securing the neckband and thus the collar about the neck of a wearer, the improvement comprising:

at least one cut formed transversely in the neckband, extending through the lower edge thereof, to enable the material of the neckband to spread apart at the cut when a longitudinal force is applied to the neckband, thereby increasing the effective length of the neckband to compensate for shrinkage of the shirt or an increase in neck size of the wearer, said at least one cut has a lower end terminating below the lower edge of the neckband in a circular opening.

17. In a shirt having a shirt body, an elongate neckband, and a collar, wherein the neckband is adapted to encircle the neck of a wearer and has upper and lower edges connected to the collar and to the shirt body, respectively, and opposite ends, and a fastening means is on the ends of the neckband for securing the neckband and thus the collar about the neck of a wearer, the improvement comprising:

at least one cut formed transversely in the neckband, extending through the lower edge thereof, to enable the material of the neckband to spread apart at the cut when a longitudinal force is applied to the neckband, thereby increasing the effective length of the neckband to compensate for shrinkage of the shirt or an increase in neck size of the wearer, said at least one cut is a slit made transversely in the neckband, said slit has a top end, and a bottom end spaced below the lower edge of the neckband, and lines of reinforcing stitching extend across the top and bottom ends of the slit, the line of stitching across the top end of the slit comprising a short straight line of stitching, and the line of stitching across the bottom end of the slit comprising an arcuate line of stitching that curves upwardly at opposite ends thereof.

* * * * *